United States Patent [19]

Tamaki et al.

[11] 4,331,617

[45] May 25, 1982

[54] CARBURETOR

[75] Inventors: Kazufuto Tamaki, Nagoya; Tadayoshi Iwazaki; Shigeo Takayanagi, both of Aichi; Saburo Yamamoto, Nagoya, all of Japan

[73] Assignee: Toyota Jidosha Hanbai Kabushiki Kaisha, Nagoya, Japan

[21] Appl. No.: 183,642

[22] Filed: Sep. 3, 1980

Related U.S. Application Data

[63] Continuation-in-part of Ser. No. 73,793, Sep. 10, 1979, abandoned.

[30] Foreign Application Priority Data

Sep. 14, 1978 [JP] Japan ..... 53-113471

[51] Int. Cl.[3] ..... F02M 5/08

[52] U.S. Cl. ..... 261/72 R; 261/DIG. 67

[58] Field of Search ..... 261/DIG. 67, 72 R

[56] References Cited

U.S. PATENT DOCUMENTS

| | | | |
|---|---|---|---|
| 1,586,683 | 6/1926 | Mock | 261/72 R |
| 1,752,959 | 4/1930 | Monier | 261/DIG. 67 |
| 2,694,560 | 11/1954 | Olson | 261/72 R |
| 2,731,251 | 1/1956 | Lunn | 261/DIG. 67 |
| 2,957,683 | 10/1960 | Eberhardt | 261/DIG. 67 |
| 3,307,837 | 3/1967 | Winkler | 261/DIG. 67 |
| 3,656,736 | 4/1972 | York, Jr. | 261/DIG. 67 |
| 3,742,924 | 7/1973 | Bachle | 261/DIG. 67 |
| 3,959,417 | 5/1976 | Tateno et al. | 261/DIG. 67 |
| 3,968,189 | 7/1976 | Bier | 261/DIG. 67 |
| 4,040,399 | 8/1977 | Meininger | 261/DIG. 67 |

OTHER PUBLICATIONS

Foundations of Fluid Mechanics, S.W. Yuan, Prentice-Hall, Inc., Englewood Cliffs, N.J., Cpr. 1967, pp. 375-378.

*Primary Examiner*—Tim R. Miles

*Attorney, Agent, or Firm*—Oblon, Fisher, Spivak, McClelland & Maier

[57] ABSTRACT

A carburetor comprises an intake passage for supplying air and fuel, a venturi located in the intake passage, a nozzle opened in the venturi, a float member communicated with a fuel supply source and with the nozzle, an air vent for communicating the space above the liquid surface in the float chamber with the intake passage upstream of the venturi, and two communication conduits each of which has one end opened above the liquid surface in the float chamber and the other end opened at a suitable position in the intake passage in such a manner that a pressure difference is caused between the two communication conduits. One end of the first communication means is provided close to a fuel opening connected to the fuel supply source in the float chamber and the other end thereof receives higher pressure. One end of the second communication means is provided far from the fuel opening and the other end thereof receives lower pressure. With this structure, air is allowed to flow, from one end of the first communication means close to the fuel opening to one end of the second communication means far from the fuel opening, within the space above the liquid surface in the float chamber, to cool down and push away fuel bubbles formed on the liquid surface nearby the fuel opening in the float chamber, thereby preventing the fuel jetting from the air vent into the intake passage.

17 Claims, 5 Drawing Figures

CARBURETOR

CROSS REFERENCE TO RELATED APPLICATION

This application is a Continuation-In-Part application of our co-pending Application Ser. No. 073,793 filed Sept. 10, 1979 for CARBURETOR, now abandoned.

BACKGROUND OF THE INVENTION

1. Field of the Invention

This invention relates to carburetors, and more particularly to an improvement of a carburetor provided with an air vent (or a communication mechanism) having one end opened in the float chamber and the other end opened in the air horn section provided upstream of the venturi to make the pressure in the float chamber substantially equal to that in the air horn section.

2. Description of the Prior Art

In a carburetor of a type in which one end of one of the air vent tubes is provided close to the fuel opening connected to the fuel supply source in the float chamber, through which opening fuel is dropped in accordance with the engine operating conditions, misfire may occur in the engine by the abnormally rich air-fuel mixture when the engine is stopped after a high load operation and then started within a short period of time and operated again under high load.

The inventors have conducted systematic experiments and analyzed this phenomenon as follows.

Fuel bubbles are formed above the liquid surface in the float chamber during the high load operation probably for the reasons below:

(a) During the high load operation, the temperature of the fuel is increased, resulting in that the low boiling point components in the fuel are boiled to form a number of fuel bubbles.

(b) In a carburetor of a type in which fuel is fed from upward (as shown in FIGS. 1(A) and 1(B) to be described below), fuel bubbles are formed when fuel is dropped through the needle valve and collided with or splashed on a plate for pushing up and down the needle valve and for supporting the float. This is particularly true when fuel is dropped in a large amount under high load.

(c) Due to vibration of the engine, the liquid surface in the float chamber is waved to cause the float together with its supporting plate (onto which fuel is dropped) to vibrate. This is also considered to promote the formation of fuel bubbles.

These fuel bubbles each having a bubble wall occupy a large space above the liquid surface as compared with the mere fuel vapor. Further, with the increase in the temperature within the float chamber, such fuel bubbles will be enlarged.

When the engine is stopped after a high load operation, restarted within a short period of time and reaches the high load state again, a large amount of fuel will be fed over the fuel bubbles thus formed. In this case, if an air vent tube is provided close to this place, i.e. close to the fuel opening, the fuel fed in liquid state over the walls of fuel bubbles, as well as fuel bubbles themselves, flow out through the air vent tube. As a result, the air-fuel mixture becomes extremely rich, causing misfire in the engine.

SUMMARY OF THE INVENTION

A primary object of the invention is to provide a carburetor in which all of the above-described difficulties accompanying a conventional carburetor with an air vent have been eliminated.

Another object of the invention is to provide a carburetor in which fuel bubbles are not present above the liquid surface near the fuel opening in the float chamber so that the fuel is prevented from being supplied on the fuel bubbles and jetted through the air vent into the air horn section in the intake passage.

A further object of the invention is to provide a carburetor in which two communication means are provided to communicate suitable portions of the intake passage with the space above the liquid surface in the float chamber in such a manner that a pressure difference is caused between the two communication conduits so that air is allowed to flow from one of the two communication conduits under higher pressure through the space above the liquid surface in the float chamber to the other communication conduits under lower pressure to cool the space above the liquid surface in the float chamber, thereby to prevent the production of fuel bubbles above the liquid surface in the float chamber, and to suppress or push away the produced fuel bubbles.

The foregoing objects and other objects of the invention have been achieved by the provision of a carburetor comprising an intake passage for supplying suction air and fuel, a venturi obtained by reducing the intake passage, a nozzle opened in the venturi, a float chamber incorporating a float, a fuel opening formed on an upper wall of said fuel chamber and communicated with a fuel supply source through a communication passage, a plate pivotably supported and fixed to said float, and a needle valve inserted within said fuel opening and contacted with said plate for axially sliding within said fuel opening in response to the variation of fuel level in said float chamber and an air vent having two air vent tubes communicating the space above the liquid surface in the float chamber with the intake passage upstream of the venturi. In the carburetor, according to the invention, two communication means are provided each of which has one end opened above the liquid surface in the float chamber and the other end opened at a suitable position in the intake passage in such a manner that a pressure difference is caused between the two communication means. One end of the first communication means is provided close to a fuel opening connected to the fuel supply source in the float chamber and the other end thereof receives higher pressure. One end of the second communication means is provided far from the fuel opening and the other end thereof receives lower pressure.

In the carburetor thus constructed according to the invention, air is allowed to flow from the first communication means under higher pressure through the space above the liquid surface in the float chamber to the second communication means under lower pressure. Also, air is allowed to flow, from one end of the first communication means close to the fuel opening to one end of the second communication means far from the fuel opening, within the space above the liquid surface in the float chamber, to cool down and push away fuel bubbles formed on the liquid surface nearby the fuel opening in the float chamber. This prevents the production of fuel bubbles above the liquid surface in the float chamber and to suppress and to push away the produced fuel bubbles, which results in the prevention of the problem that a large amount of fuel is supplied over the fuel bubbles and jetted from the space above the liquid surface in the float chamber through the air vent into the air horn section in the intake passage to cause a misfire in the engine by the abnormally rich air-fuel mixture.

This invention has the following aspects:

According to a first aspect of the invention, the other ends of the above-described two communication conduits are opened at positions different from each other in the direction of flow of the air in the intake passage, so that different static pressures are applied to the other ends of the two communication conduits, respectively.

In the carburetor according to the first aspect of the invention, the end openings of the two communication conduits are provided upstream and downstream of the venturi, respectively, or one of the end openings is provided in the venturi while the other is provided in the intake passage upstream or downstream of the venturi, so that different static pressures are applied to the other ends of the communication conduits; that is, a predetermined pressure difference is caused between the two communication conduits.

According to a second aspect of the invention, the other ends of the two communication conduits are opened at different positions from each other at a distance from the center of the intake passage on substantially the same plane perpendicular to the flow therein, so that different dynamic pressures attributed to the flow of air in the intake passage are applied to the other ends of the two communication conduits.

More specifically, in a carburetor according to the second aspect of the invention, the end openings of the two communication conduits are provided at positions different from each other in distance from the center of the intake passage so that the end openings of the two communication conduits are subjected to air flows different in velocity in the intake passage, whereby different dynamic pressures are applied to the other ends of the two communication conduits, thereby to cause a predetermined pressure difference between the two communication conduits.

According to a third aspect of the invention, the other ends of the two communication conduits are different from each other in configuration to provide different dynamic-pressure-receiving areas, the other ends being on substantially the same plane perpendicular to the flow in the intake passage, whereby different dynamic pressures are applied to the other ends of the two communication conduits, respectively.

In other words, in a carburetor according to the third aspect of the invention, the end openings of the two communication conduits are provided substantially on the same place in the intake passage, but are different from each other in configuration, whereby different dynamic pressures are applied to the other ends of the two communication conduits thereby to cause a predetermined pressure difference between the two communication conduits.

An example of the carburetor according to the third aspect of the invention is as follows:

In this example, the other ends of the two communication conduits are opened in the central portion of an air horn section provided upstream of the venturi in such a manner that the opening of one of the other ends is perpendicular to the direction of flow in the intake passage, while the opening of the other is in parallel with the direction of flow in the intake passage.

As the opening of one of the other ends of the communication conduits is perpendicular to the direction of flow in the intake passage, the dynamic pressure of the flow is applied thereto; however, as the opening of the other is in parallel with the direction of flow in the intake passage, no dynamic pressure is applied thereto. Accordingly, the pressure difference corresponding to the dynamic pressure applied to one of the two communication conduits is caused between the two communication conduits, as a result of which air is caused to flow from the communication conduit under higher pressure through the space above the liquid surface in the float chamber to the communication conduit under lower pressure to cool the space above the liquid surface in the float chamber, thereby to prevent the production of fuel bubbles above the liquid surface in the float chamber, and to suppress and push away the produced fuel bubbles. Thus, the carburetor can prevent the problem that a large amount of fuel is supplied over the fuel bubbles and jetted or overflow from the space above the liquid surface in the float chamber through the air vent into the air horn section in the intake passage to cause a misfire in the engine by a too rich air-fuel mixture.

In addition to this effect, another effect resides in that the example described above can be obtained merely by modifying a carburetor with an air vent having two conventional air vent tubes communicating the space above the liquid surface in the float chamber with the intake passage upstream of the venturi, or with the air horn section, each of the two air vent tubes having one end opened in the air horn section perpendicular to the direction of flow in the intake passage. Namely, by cutting such an end of one of the two air vent tubes in parallel with the direction of flow in the intake passage, the invention can be obtained.

BRIEF DESCRIPTION OF THE DRAWINGS

Various other objects, features and attendant advantages of the present invention will be more fully appreciated as the same becomes better understood from the following detailed description of the drawings when considered in connection with the accompanying drawings in which like reference characters designate like or corresponding parts throughout the several views, and wherein.

DETAILED DESCRIPTION OF THE PREFERRED EMBODIMENTS

An embodiment of the carburetor according to the third aspect of the invention and according to its example will be described with reference to FIGS. 1 and 2.

Figure 1A:
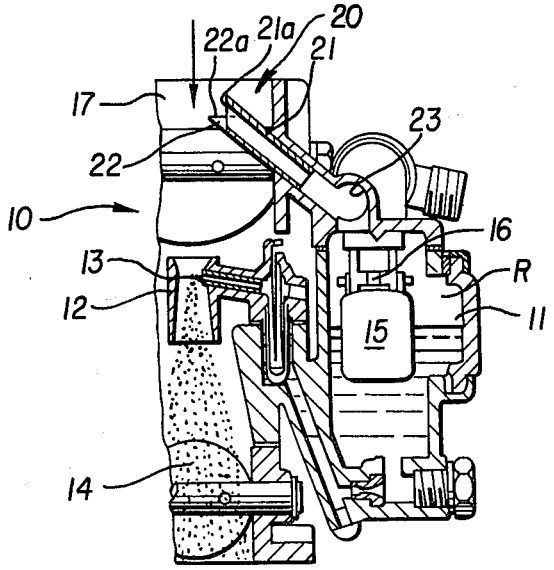
FIG. 1(A) is a vertical sectional view taken along the line IB—IB in FIG. 1(B) and shows a part of an automobile gasoline engine carburetor which is one embodiment according to the third aspect of this invention.
Figure 2:
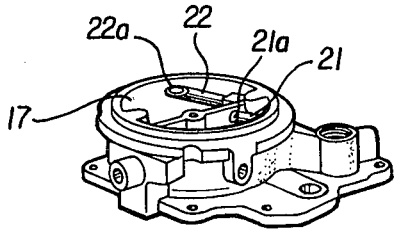
FIG. 2 is a perspective view showing the air horn section of the carburetor illustrated in FIG. 1(A)
Figure 1B:
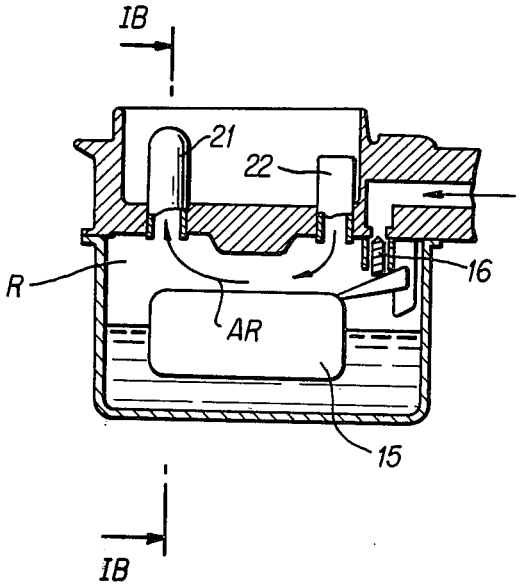
FIG. 1(B) is another vertical sectional view showing the part of an automobile gasoline engine carburetor shown in FIG. 1(A)

FIGS. 1(A) and 1(B) illustrate a carburetor 10 of an automobile gasoline engine. The carburetor 10 comprises a float chamber 11 for containing a predetermined amount of gasoline, a venturi 12 for controlling the amount of suction air, a main nozzle 13 opened in the venturi 12 and communicating with the float chamber 11, and a throttle valve 14 disposed downstream of the venturi 12, so as to provide suitable proportions and quantity of air-fuel mixture in response to operating conditions of the engine and to atomize the gasoline so that it can be readily vaporized in the engine. The liquid level in the float chamber 11 is maintained unchanged at all times because a needle valve 16 provided on a float 15 controls the supply of gasoline fed from upward from a fuel tank (not shown) by a pump.

The embodiment described above is provided with an air vent 20 having two air vent tubes 21 and 22, which correspond to an air vent employed in a conventional carburetor to make the pressure in the float chamber 11 substantially equal to the pressure in an air horn section 17 provided upstream of the venturi 12. The tubes 21 and 22 are provided in the secondary and primary passages of the carburetor, respectively. The tube 21 is fitted in a passage 23, and has the upper end opened in the air horn section 17 and the lower end communicated through the passage 23 with the space above the liquid surface in the float chamber 11. The upper end opening 21*a* of the tube 21 is in parallel with the direction of flow of suction air, and is subjected to negative suction pressure by the flow of suction air. As shown in FIG. 1(B), the other tube 22 is fitted in a passage similar to the passage 23, and has the upper end opened in the air horn section 17 and the lower end communicated through the passage with the position close to the needle valve 16 as the fuel supply opening connected to the fuel tank, in the space above the liquid surface in the float chamber 11. The upper end opening 22*a* of the tube 22 is perpendicular to the direction of flow of suction air. As dynamic pressure due to the flow of suction air is applied to the upper end opening 22*a*, the latter 22*a* is subjected to a pressure approximately equal to the atmospheric pressure by the suction air (see FIG. 2).

With the carburetor thus constructed, during the engine operation, a pressure difference is caused between the upper end opening 21*a* of the tube 21 and the upper end opening 22*a* of the tube 22 by the suction air, so that a part of the air (external air) which is sucked into the air horn section 17 at a relatively low temperature is passed through the upper end opening 22*a* of the tube 22 and the float chamber 11 and through the upper end opening 21*a* of the tube 21 to the air horn section 17. As a result, in the chamber R formed above the liquid surface in the float chamber 11, air flow is formed from the lower end of the tube 22 close to the needle valve 16 in the float chamber 11 to the lower end of the tube 21 far from the needle valve 16 in the chamber R, as shown by an arrow AR in FIG. 1(B), and the ventilation is accomplished. Accordingly, fuel bubbles are cooled down or suppressed to disappear immediately by the external air at the relatively low temperature or pushed away to the position far from the needle valve in the chamber R. Thus, the fuel is prevented from being supplied over the fuel bubbles and jetted or overflowed into the air horn section 17 through the air vent 20. Accordingly, no abnormally rich air-fuel mixture is supplied to the engine, and therefore the engine misfire can be positively prevented.

In the above-described embodiment, the tube 21 in the secondary passage is so designed that the pressure difference between the two tubes is set to a predetermined value (for instance 5 to 6 mm Hg). Thus, the embodiment is advantageous in that it provides an optimum ventilation efficiency, and optimum and stable effects of pushing away fuel bubbles and preventing engine misfires.

In the above-described carburetor 10, the upper end opening 21*a* of the tube 21 is provided in parallel with the direction of flow of the suction air, while the upper end opening 22*a* of the tube 22 is provided perpendicularly to the direction of flow of the suction air, so that the dynamic pressure according to the velocity of the suction air is provided to ventilate the chamber R; however, it should be noted that the invention is not limited thereto or thereby. That is, the invention can be applied to a variety of carburetors without lowering their performances if the directions and/or inner diameters of the openings of the two air vent tubes are suitably modified.

The above-described embodiment has the advantage that two air vent tubes in the air vent usually employed in the automobile gasoline engine carburetor are effectively utilized as ventilating means for ventilating the chamber R by merely modifying the shape of the opening of one of the tubes, i.e. the upper end opening 21*a* of the tube 21 provided in the secondary passage. In this case, the opening of the tube 21 in the secondary passage is modified, but the opening of the tube 22 in the primary passage is modified if the lower end of tube 22 is located close to the fuel opening.

Furthermore, the invention can be variously modified. For instance, the two air vent tubes may be employed as the ventilating means by attaching an adaptor tube having a predetermined configuration corresponding to the opening 21*a* of the tube 21 described above to one of the air vent tubes. Otherwise, the ventilating means may be a combination of one or two of the conventional air vent tubes (having the other end opened in the intake passage perpendicularly to the direction of flow) and a new communication conduit having one end opened above the liquid surface in the float chamber and the other end opened in the intake passage in parallel with the direction of flow. Further, two new communication conduits may be provided as ventilating means, aside from the conventional air vent tubes, insofar as a pressure difference is caused between the end openings of the two communication conduits.

The above-described embodiment belongs to the third aspect of the invention. However, the invention is not limited thereto or thereby; that is, the invention has the following aspects.

Figure 3A:
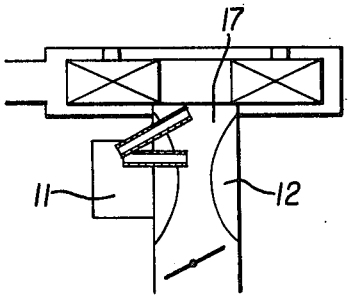
FIGS. 3(A) through 3(C) are sectional views showing examples of the carburetor according to the first aspect of the invention.
Figure 3:
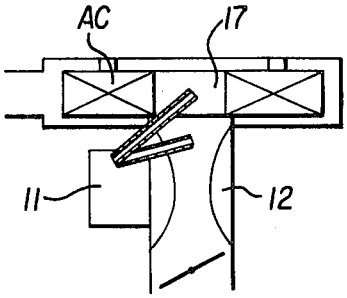
Figure 3:
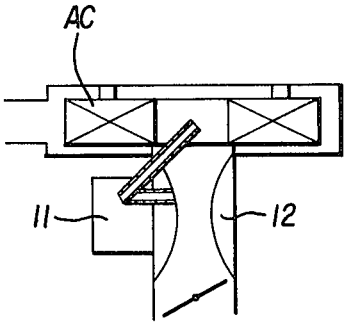

Examples of the carburetor according to the first aspect of the invention are shown in FIGS. 3(A) through 3(C). In the example shown in FIG. 3(A), one communication conduit is opened in the air vent section 17 provided upstream of the venturi 12, and the other communication conduit is opened at a predetermined position in the venturi 12. In the example shown in FIG.

3(B), one communication conduit is opened downstream of an air cleaner AC, and the other communication conduit is opened in the upstream part of the venturi 12. In the example shown in FIG. 3(C), one communication conduit is opened downstream of an air cleaner AC, and the other communication conduit is opened at a predetermined position in the venturi 12. In the above-described three examples, it is necessary to position the two communication conduits so that the pressure difference between the two communication conduits is a predetermined value.

Figure 4B:
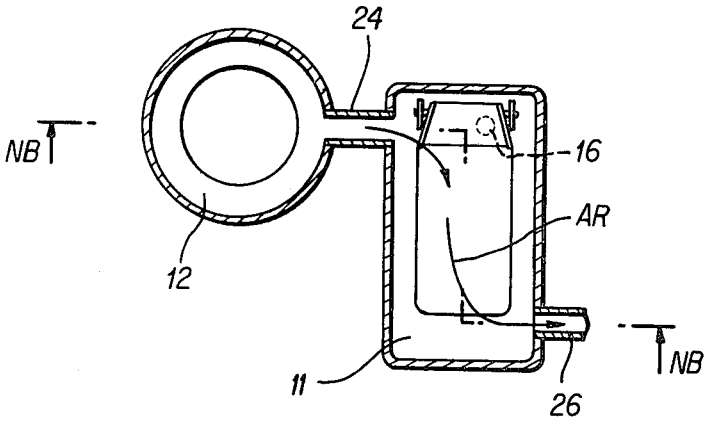
FIG. 4(B) is a cross-sectional view taken along the line IVA—IVA in FIG. 4(A) and shows the carburetor illustrated in FIG. 4(A)
Figure 4A:
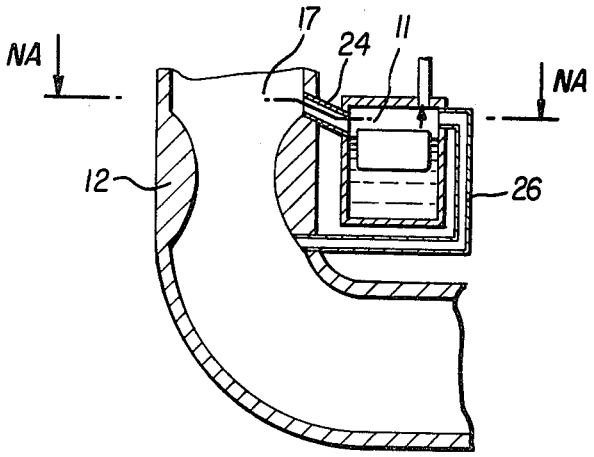
FIG. 4(A) is a sectional view taken along the line IVB—IVB in FIG. 4(B) and shows another example of the carburetor according to the first aspect of the invention.

Another example of the carburetor according to the first aspect of the invention is shown in FIGS. 4(A) and 4(B). This example also has two communication conduits. One of the communication conduits 24 has one end opened in the air horn section 17 in the intake passage and the other end opened above the liquid surface in the float chamber 11. The other communication conduit 26 has one end opened downstream of the venturi 12 in the intake passage and the other end is opened at a position which is above the liquid surface in the float chamber and confronts the other end of the one communication conduit 24. In this example, the float chamber 11 is ventilated by the static pressure difference between the upstream part and the downstream part of the venturi 12. As the other ends of the two communication conduits are opened in the opposite walls of the float chamber 11, the ventilation efficiency is remarkably improved. The other end of the communication conduit 24 is provided nearby the needle valve, as shown in FIG. 4(B). The other end of the other communication conduit 26 is provided far from the needle valve 16 at the opposite wall to the wall of the float chamber at which the other end of the communication conduit 24 is provided.

As a result, in the chamber R formed above the liquid surface in the float chamber 11, air flow is formed from the other end of the conduit 24 close to the needle valve 16 in the float chamber 11 to the other end of the conduit 26 far from the needle valve 16 by the difference of static pressure between two communication conduits 24, 26 in the chamber, as shown by an arrow AR in FIG. 4(B) and the ventilation is accomplished.

Accordingly, fuel bubbles are cooled down or suppressed to disappear immediately by the external air at the relatively low temperature, or pushed away to the position far from the needle valve in the chamber R.

Figure 5:
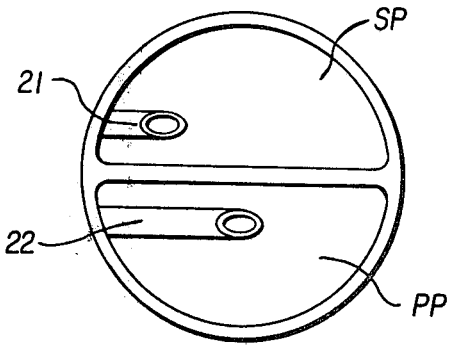
FIGS. 5(A) and 5(B) are plan views showing examples of the carburetor according to the second aspect of the invention.
Figure 5:
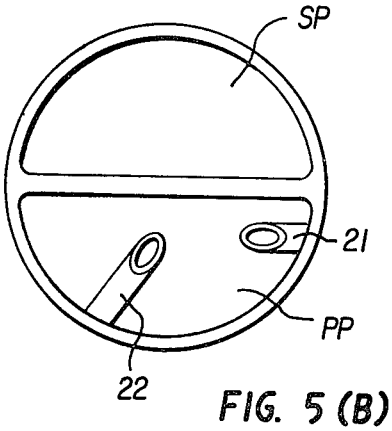

Examples of the carburetor according to the second aspect of the invention are shown in FIGS. 5(A) and 5(B). In the example shown in FIG. 5(A), one communication conduit 21 is opened at a position closer to the wall of the secondary intake passage SP and the other communication conduit 22 is opened at a position closer to the center of the primary intake passage PP. In the example shown in FIG. 5(B), one communication conduit 21 is opened at a position closer to the wall of the primary intake passage PP, and the other communication conduit 22 is opened at a position closer to the center of the same primary intake passage PP. In each of these examples, the velocity of air is different at different positions in the intake passage; that is, the velocity of air near the center is higher than the velocity of air near the wall. By utilizing this principle, the two communication conduits are opened at positions different in air velocity, so that different dynamic pressures according to different velocities of gas are produced according to different velocities of air to provide a predetermined pressure difference, thereby to ventilate the float chamber 11. In the second aspect of the invention, other examples than described above can be provided for the same effects.

Further, the above-described aspects may be combined in various ways to attain the objects of the present invention.

In summary, the specific feature of a carburetor having an air vent with one end opened in the float chamber and the other end opened in the air horn section provided upstream of the venturi resides in that, according to the invention, the float chamber is provided with the ventilating means having at least two communication conduits each of which has one end opened in the float chamber and the other end opened in the intake passage, and one end of the first communication means is provided close to a fuel opening connected to the fuel supply source in the float chamber and the other end thereof receives higher pressure, while one end of the second communication means is provided far from the fuel opening, and the other end thereof receives lower pressure. Thus, the chamber formed above the liquid surface in the float chamber is ventilated and fuel bubbles are crushed or pushed away by the air flowing in the intake passage, thereby to prevent the problems such as engine misfires described above.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A carburetor comprising:

an intake passage for supplying suction air and fuel;

a venturi located in said intake passage;

a nozzle opened in said venturi;

a float chamber having two ends and comprising a float, a fuel opening formed on an upper wall of said fuel chamber adjacent one end and communicated with a fuel supply source through a communication passage, a pivotably supported plate fixed to said float, and a needle valve inserted within said fuel opening and contacted with said plate for axially sliding within said fuel opening in response to the variation of fuel level in said float chamber wherein said fuel opening is positioned directly above said plate;

an air vent having two air vent tubes for communicating the space above the liquid surface in said float chamber with said intake passage upstream of said venturi; and first and second communication means each of which has one end opened above the liquid surface in said float chamber and the other end opened at a suitable position in said intake passage in such a manner that a pressure difference is caused between said two communication means;

one end of said first communication means being provided in said one end of said float chamber close to said fuel opening connected to said fuel supply source in said float chamber and directly above said plate, and the other end of said first communication means receiving the higher pressure, one end of said second communication means being provided in the other end of said float chamber far from said fuel opening, and the other end of said second communication means receiving the lower pressure, whereby air is allowed to flow from said first communication means under higher pressure through the space above the liquid surface in said float chamber to said second communication means under lower pressure, and air is allowed to flow, from said one end of said first communication means close to said fuel opening to said one of said second communication means far from said fuel opening, within the space above the liquid surface in said float chamber, to cool down and push away fuel bubbles formed on the liquid surface nearby said fuel opening in said float chamber, thereby preventing the fuel from being supplied over fuel bubbles and being jetted from said air vent into said intake passage.

2. A carburetor according to claim 1, wherein said other ends of said two communication means are opened at different positions from each other in the direction of flow in said intake passage so that different pressures are applied to said other ends of said two communication means, respectively.

3. A carburetor according to claim 1, wherein said other ends of said two communication means are opened at different positions from each other in distance from the center of said intake passage on substantially the same plane perpendicular to the flow therein, so that different dynamic pressures are applied to said other ends of said two communication means, respectively.

4. A carburetor according to claim 1, wherein said other ends of said two communication means are different from each other in configuration to provide different dynamic-pressure-receiving areas, said other ends being on substantially the same plane perpendicular to the flow in said intake passage, so that different dynamic pressures are applied to said other ends of said two communication means, respectively.

5. A carburetor according to claim 1, wherein said other ends of said two communication means are opened at different positions form each other in distance from the center of said intake passage, and are different from each other in configuration to provide different dynamic-pressure-receiving areas, so that different dynamic pressures are applied to said other ends of said two communication means, respectively.

6. A carburetor according to claim 2, wherein said other ends of said two communication means are opened at different positions from each other in distance from the center of said intake passage so that different dynamic pressures are applied to said other ends of said two communication means, respectively.

7. A carburetor according to claim 2, wherein said other ends of said two communication means are different from each other in configuration to provide different dynamic-pressure-receiving areas so that different dynamic pressures are applied to said other ends of said two communication means, respectively.

8. A carburetor according to claim 6, wherein said other ends of said two communication means are different from each other in configuration to provide different dynamic-pressure-receiving areas so that different dynamic pressures are applied to said other ends of said two communication means, respectively.

9. A carburetor according to claim 3, wherein said other ends of said two communication means are different from each other in configuration to provide different dynamic-pressure-receiving areas so that different dynamic pressures are applied to said other ends of said two communication means, respectively.

10. A carburetor according to claim 2, wherein said other end of said first communication means is opened in an air horn section provided in said intake passage upstream of said venturi, and said other end of said second communication means is opened at a predetermined position in said venturi.

11. A carburetor according to claim 2, wherein said other end of said first communication means is opened in the upstream part of said intake passage and said other end of said second communication means is opened in the upstream part of said venturi.

12. A carburetor according to claim 2, wherein said other end of said first communication means is opened in the upstream part of said intake passage and said other end of said second communication means is opened at a predetermined position in said venturi.

13. A carburetor according to claim 2, wherein said first communication means has said one end opened above the liquid surface in said float chamber and the other end opened in an air horn section provided in said intake passage upstream of said venturi, and said second communication means has said one end opened above the liquid surface in said float chamber at a position opposite said one end of said first communication means and said other end opened downstream of said venturi.

14. A carburetor according to claim 3, wherein said carburetor has a primary and a secondary intake passage and said other end of said second communication means is opened at a position closer to the wall of said secondary intake passage of said carburetor and said other end of said first communication means is opened at a position closer to the center of said primary intake passage of said carburetor.

15. A carburetor according to claim 3, wherein said carburetor has a primary intake passage and said other end of said second communication means is opened at a position closer to the wall of said primary intake passage of said carburetor, and said other end of said first communication means is opened at a position closer to the center of said primary intake passage.

16. A carburetor according to claim 4, wherein the opening of said other end of said first communication means is perpendicular to the direction of flow in said intake passage, and the opening of said other end of said second communication means is in parallel with the direction of flow in said intake passage.

17. A carburetor according to claim 16, wherein said first communication means is said first air vent tube provided in a primary intake passage of said carburetor, one end of said first air vent tube being communicated through a passage with the space above the liquid surface of said float chamber and the other end thereof being opened, perpendicularly to the direction of flow, in an air horn section in said intake passage upstream of said venturi, and said second communication means is said second air vent tube provided in a secondary intake passage of said carburetor, one end of said second air vent tube being communicated through said passage with the space above the liquid surface in said float chamber and the other end thereof opened, in parallel with the direction of flow, in said air horn section of said intake passage upstream of said venturi, whereby a pressure difference is caused between the openings of the other ends of said first and second air vent tubes.

* * * * *